US011026306B2

(12) United States Patent
Nicolaides

(10) Patent No.: US 11,026,306 B2
(45) Date of Patent: Jun. 1, 2021

(54) VARIABLE-INTENSITY LED MODULE, SYSTEM AND LIGHT FIXTURE

(71) Applicant: SCOUT INDUSTRIES, INC., New York, NY (US)

(72) Inventor: Alexander Nicolaides, New York, NY (US)

(73) Assignee: SCOUT INDUSTRIES, INC., New York, NY (US)

( * ) Notice: Subject to any disclaimer, the term of this patent is extended or adjusted under 35 U.S.C. 154(b) by 0 days.

(21) Appl. No.: 16/955,949

(22) PCT Filed: Jan. 2, 2019

(86) PCT No.: PCT/US2019/012082
§ 371 (c)(1),
(2) Date: Jun. 19, 2020

(87) PCT Pub. No.: WO2019/136090
PCT Pub. Date: Jul. 11, 2019

(65) Prior Publication Data

US 2020/0329538 A1 Oct. 15, 2020

Related U.S. Application Data

(60) Provisional application No. 62/612,871, filed on Jan. 2, 2018.

(51) Int. Cl.
*H05B 45/10* (2020.01)
*H05B 45/44* (2020.01)
*G05F 3/18* (2006.01)

(52) U.S. Cl.
CPC ..... *H05B 45/10* (2020.01); *G05F 3/185* (2013.01); *H05B 45/44* (2020.01)

(58) Field of Classification Search
CPC ..... H05B 33/08; H05B 39/041; H05B 41/38; H05B 45/10; H05B 45/14; H05B 45/20;
(Continued)

(56) References Cited

U.S. PATENT DOCUMENTS 7,119,498 B2 * 10/2006 Baldwin ..... H05B 45/10 315/291
8,704,446 B2 * 4/2014 Gibbs ..... H05B 45/14 315/122

(Continued)

FOREIGN PATENT DOCUMENTS

CN 202276518 U 6/2012

OTHER PUBLICATIONS

International Search report for corresponding PCT Application No. PCT/US2019/012082 dated Mar. 5, 2019.

*Primary Examiner* — Long Nguyen
(74) *Attorney, Agent, or Firm* — Budzyn IP Law, LLC

(57) ABSTRACT

In a first aspect, the subject invention provides a variable-intensity light emitting diode (LED) module which includes: a first LED string having first and second ends, the first end being connected to a positive voltage terminal which is connectable to a positive voltage input of a direct current voltage source; a first terminal connected to a first resistor which is connected to the second end of the first LED string; and, a second terminal connected to a second resistor which is connected to the second end of the first LED string. The first and second resistors have different resistances. A negative voltage input of the direct current voltage source is selectively connectable to one of the first and second terminals, whereby, the intensity of light generated by the first LED string is determined by which of the first and second terminals is connected to the negative voltage input.

20 Claims, 11 Drawing Sheets

(58) Field of Classification Search
CPC ..... H05B 45/24; H05B 45/34; H05B 45/345; H05B 45/40; H05B 45/44; H05B 45/46; H05B 45/48; G05F 3/185
See application file for complete search history.

(56) References Cited

U.S. PATENT DOCUMENTS

| | | | |
|---|---|---|---|
| 2009/0273300 | A1 | 11/2009 | Kayser |
| 2014/0361695 | A1 | 12/2014 | Akiyama et al. |

* cited by examiner

VARIABLE-INTENSITY LED MODULE, SYSTEM AND LIGHT FIXTURE

CROSS-REFERENCE TO RELATED APPLICATIONS

This application is a National Stage Application under 35 U.S.C. § 371 of PCT International Application No. PCT/US2019/012082, filed Jan. 2, 2019, which claims priority to U.S. Provisional Patent Application No. 62/612,871, filed Jan. 2, 2018, the entire contents of which are incorporated by reference herein.

BACKGROUND OF THE INVENTION

Solid state lighting has become increasingly used in lighting applications. Light emitting diodes (LEDs) are commonly used in such applications. The size of LEDs and control over the intensity of generated light provides versatility. Standard LED circuits, however, are typically fixed with a target intensity, such intensity possibly being varied by a dimmer circuit.

SUMMARY OF THE INVENTION

In a first aspect, the subject invention provides a variable-intensity light emitting diode (LED) module which includes: a board; a first LED string, mounted to the board, having first and second ends, the first end being connected to a positive voltage terminal which is connectable to a positive voltage input of a direct current voltage source; a first terminal, mounted to the board, connected to a first resistor which is connected to the second end of the first LED string; and, a second terminal, mounted to the board, connected to a second resistor which is connected to the second end of the first LED string. The first and second resistors have different resistances. A negative voltage input of the direct current voltage source is selectively connectable to one of the first and second terminals, whereby, the intensity of light generated by the first LED string is determined by which of the first and second terminals is connected to the negative voltage input. Advantageously, the subject invention provides a variable-intensity light module which may be used in a larger system and in a light fixture.

These and other features of the subject invention will be better understood through a study of the following detailed description and accompanying drawings.

DETAILED DESCRIPTION OF THE INVENTION

With reference to the Figures, a variable-intensity light emitting diode (LED) module is shown and generally designated with the reference number 10. The module 10 generally includes a printed circuit board (PCB) 12, a plurality of LED strings 14 mounted to the board 12, and circuitry mounted to the board 12 to allow for varying the intensity of light generated by the LED strings 14. The board 12 may be of any known type with all connections being formed on the board 12 using known techniques, including using known trace techniques. The LEDs 16 of the light strings 14 may be of any type include standard LEDs, organic LEDs (OLEDs), and polymeric LEDs (PLEDs). The LEDs 16 may be white LEDs, but other colors may be utilized as well.

Figure 1:
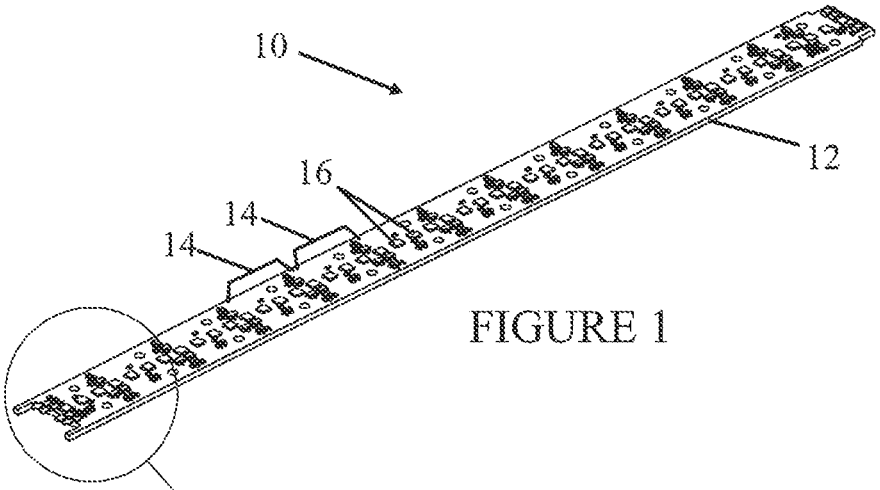
FIG. 1 is a perspective view of a LED module formed in accordance with the subject invention.
Figure 2:
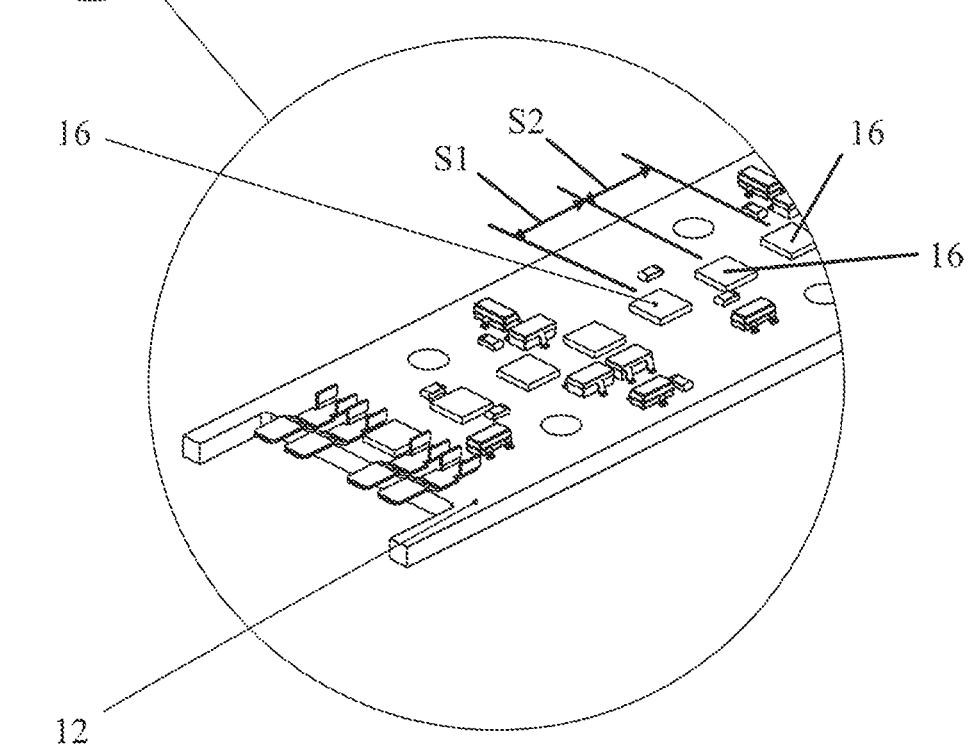
FIG. 2 is an enlarged view of a section of the module of FIG. 1.

The board 12 may be of any dimension, including being elongated, as shown in FIG. 1. This allows for the module 10 to form a strip of light. The LED strings 14, although wired in parallel, may be physically arranged in an end-to-end fashion. This allows for a continuous strip to be formed. It is preferred that the LEDs 16 be evenly spaced along the length of the board 12, including within the LED strings 14 and between the LED strings 14. Thus, as shown in FIG. 2, intra-string spacing S1 represents on-center spacing between two of the LEDs 16 on the same LED string 14, while inter-string spacing S2 represents on-center spacing between two LEDs 16 of different LED strings 14 (i.e., spacing between the terminal LEDs of two adjacent LED strings 14). To maintain even spacing along the full length of the board, the spacing S1 is preferably equal to the spacing S2. Both S1 and S2 may be equal to 0.25 inches. Even spacing allows for a generally continuous presentment of generated light, thus, minimizing dark spots along the module 10. In addition, even spacing allows for the module 10 to be provided with a rating based on length, such as, light production per increment of length (e.g., lumens/foot), an amount of current consumed per increment of length (e.g., milliamperes/foot), and/or, amount of power consumed per increment of length (e.g., watts/foot).

Figure 3:
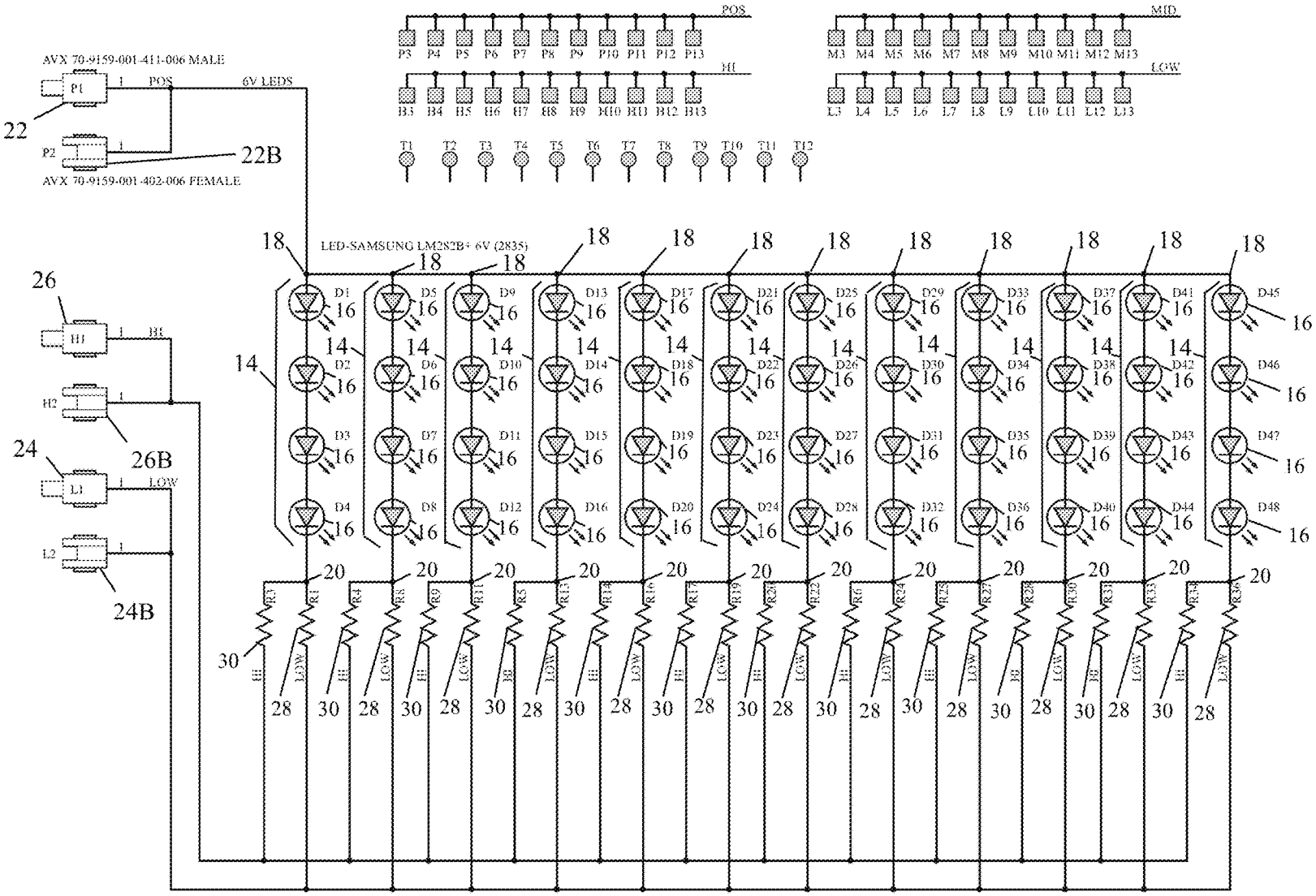
FIGS. 3-4 are schematics of circuitry allowing for varying intensity of light generated by a LED module in accordance with the subject invention.

The module 10 is provided with variable intensity allowing for users to select different levels of light intensity for the same module 10. As shown in FIG. 3, in one embodiment, the LED strings 14 are wired in parallel, with any quantity of the LED strings 14 being utilized, the quantity being generally a function of the length of the board 12. The LED strings 14 each have a first end 18 and a second end 20, with the first ends 18 of all the LED strings 14 being connected to a positive voltage terminal 22 which is connectable to a positive voltage input of a direct current voltage source, such as a driver, battery, solar panel, and so forth. The direct voltage source may be provided separate from the module 10, such as being included in a light fixture along with the module 10. The direct current voltage source may be set to provide 24 VDC to the module 10, both other levels of direct current voltage may be utilized.

The module 10 further includes a first terminal 24 and a second terminal 26. The first and second terminals 24, 26 are connected in parallel to each of the second ends 20 of the LED strings 14. A first resistor 28 is provided between the first terminal 24 and each of the second ends 20 of the LED strings 14. In addition, a second resistor 30 is provided between the second terminal 26 and each of the second ends 20 of the LED strings 14. It is preferred that all of the first resistors 28 be provided with the same resistance and that all of the second resistors 30 be provided with the same resistance. The first resistors 28 are set to a different resistance from the second resistors 30. With this arrangement, a negative voltage input of the direct current voltage source may be selectively connected to one of the first and second terminals 24, 26, with the intensity of the light generated by the LED strings 14 being determined by which of the first and second terminals 24, 26 is connected to the negative voltage input. The difference in intensity is defined by the resistances of the first and second resistors 28, 30. A higher resistance causes less current flow to the LED strings 14 and, thus, less light intensity. Thus, for example, setting each of the first resistors 28 to a resistance of 150 ohms and setting each of the second resistors 30 to a resistance of 75 ohms will result in the second terminal 26, with negative voltage applied thereto, allowing for generally twice the intensity of light being generated by the LED strings 14 as compared to light generated by the LED strings 14 with negative voltage applied to the first terminal 24.

The intensity of light generated by LEDs may be characterized in terms of color temperature with higher temperature correlating to more intense (brighter) light. The intensity of light of the module 10 may be controlled by varying the colors of the LEDs 16, including using red, blue, green, warm white, and cool white LEDs in various combinations. As appreciated by those skilled in the art, the colors of the LEDs 16 cannot be varied during use, with intensities being varied by the amount of current delivered to the LEDs 16, as described above, and through the optional use of a dimmer, as described below.

Figure 4:
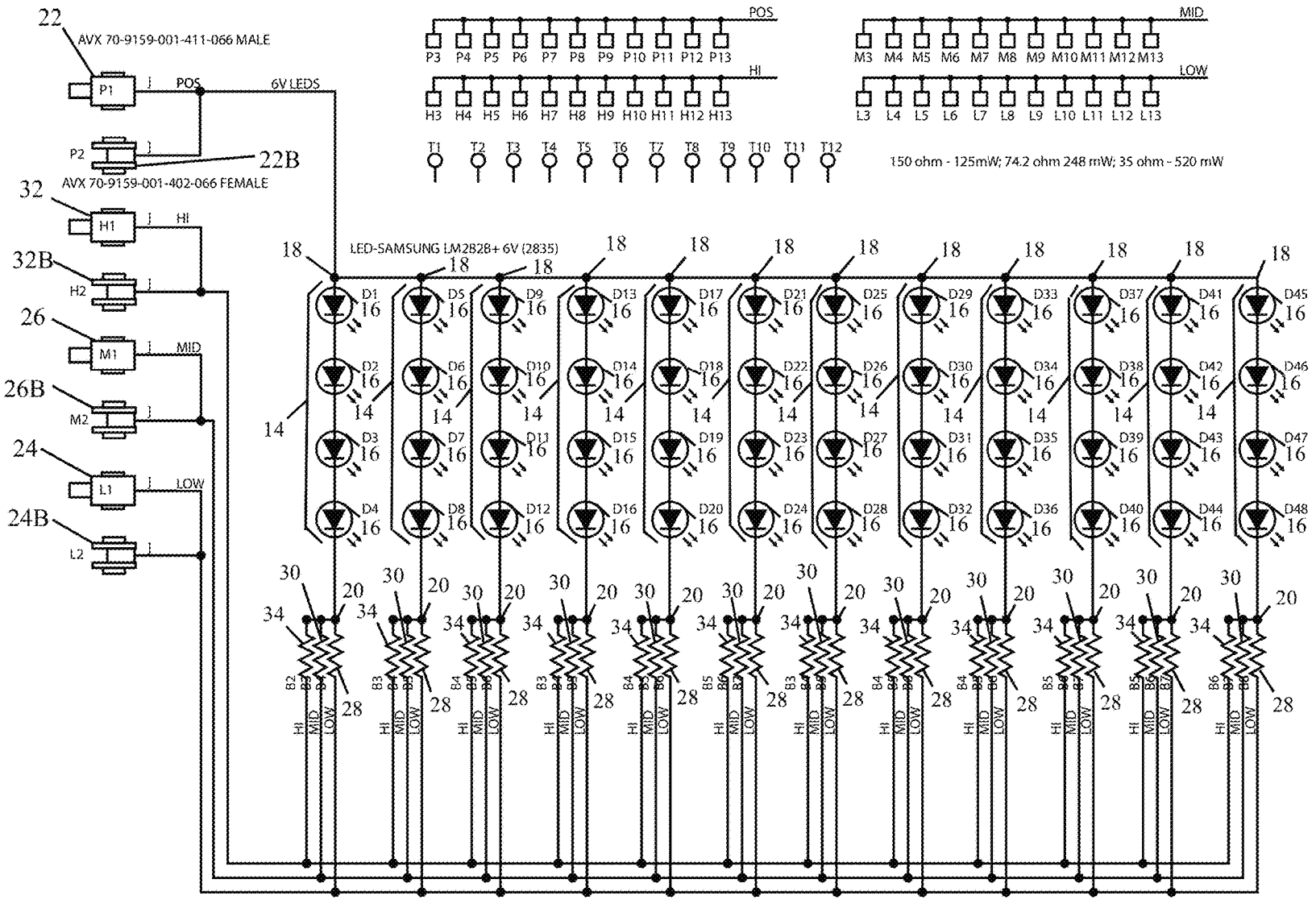

As will be appreciated by those skilled in the art, the number of terminals 24, 26 may be varied with the subject invention to allow for various intensities of light to be generated by the module 10. For example, as shown in FIG. 4, a third terminal 32 may be provided connected to each of the first ends 18 of the LED strings 14, in parallel to the first and second terminals 24, 26. A third resistor 34 may be provided between the third terminal 32 and each of the second ends 20 of the LED strings 14. It is preferred that all of the third resistors 34 be provided with the same resistance. The third resistors 34 are set to a resistance different from the resistances of the first and second resistors 28, 30. This allows for a third level of intensity to be achieved with the module. For example, each of the third resistors 34 may be set to a resistance of 35 ohms. This allows for more intense light to be generated by the LED strings 14 with negative voltage applied to the third terminal 32 as compared to the light generated through use of either the first terminal 24 or the second terminal 26.

Figure 5:
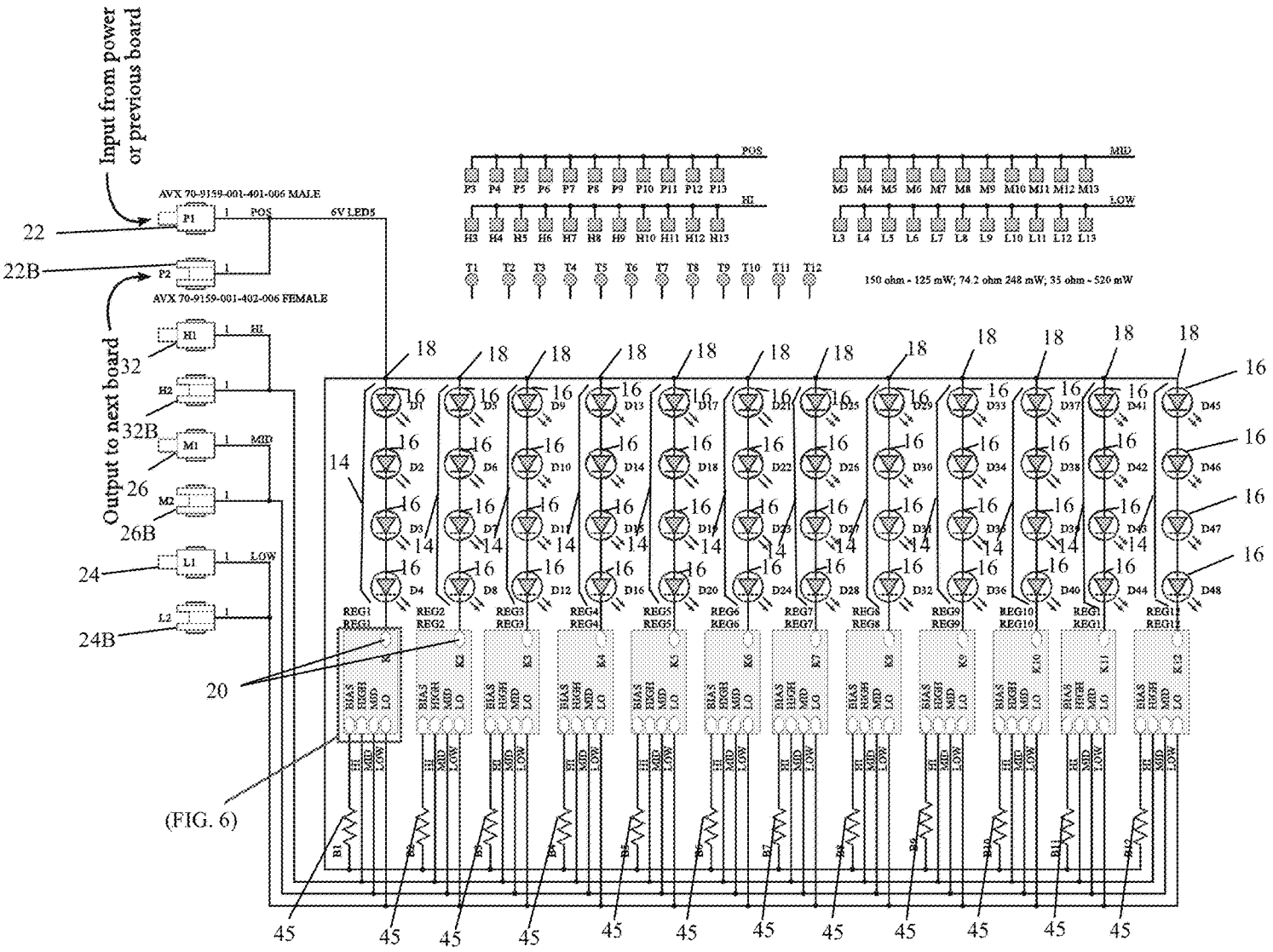
FIGS. 5-6 are schematics of a current regulator and switch which may be optionally utilized with the subject invention.
Figure 6:
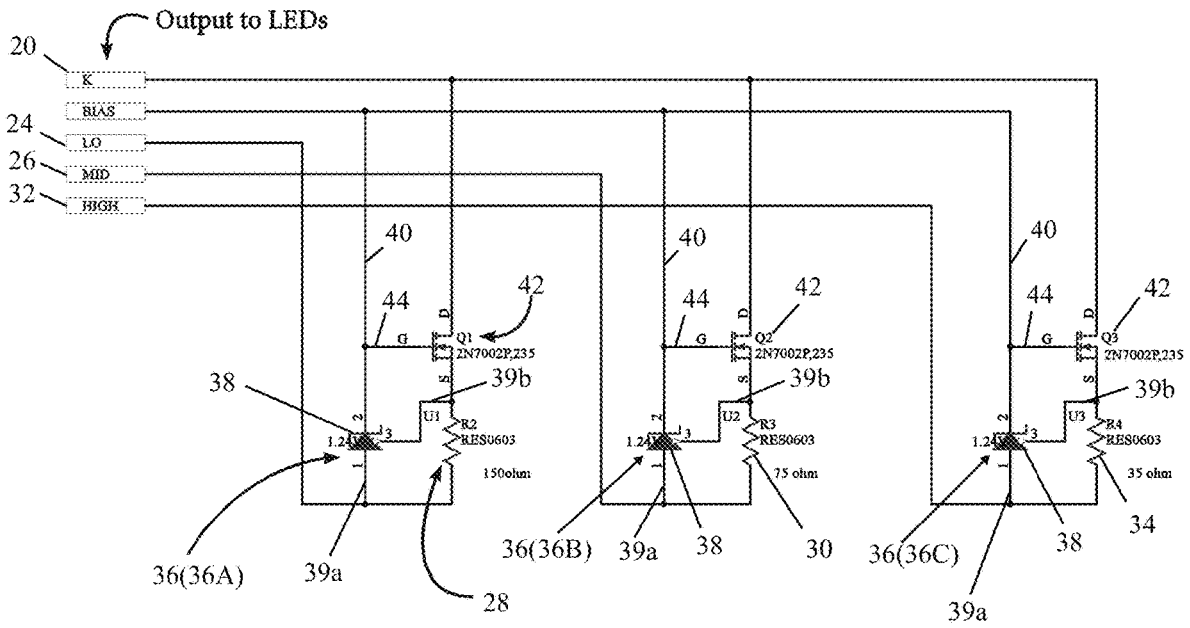

With reference to FIGS. 5 and 6, a second embodiment is provided where constant current is provided to the LED strings 14. In particular, for each of the LED strings 14, a current regulator 36 is provided in parallel to the respective first, second, third resistor 28, 30, 34. For example, for each of the LED strings 14, a first current regulator 36A is provided in parallel to the first resistor 28, a second current regulator 36B is provided in parallel to the second resistor 30, and a third current regulator 36C is provided in parallel to the third resistor 34. Any configuration of current regulator may be utilized which provides constant voltage across the respective first, second, third resistor 28, 30, 34. By way of non-limiting example, each of the current regulators 36 may include a Zener diode 38. Bias lines 40 are provided, as shown in FIG. 5, to carry positive voltage from the positive voltage terminal 22 to each of the Zener diodes 38. The Zener diodes 38 provide a constant voltage, e.g., a voltage of 1.24 VDC, across the respective first, second, and third resistors 28, 30, 34, e.g., between lines 39*a* and 39*b*. With constant voltage across the respective first, second, third resistors 28, 30, 34, constant current may be delivered therefrom.

Switches 42 may be also provided for each of the LED strings 14. As shown in FIG. 6, the switches 42 may be located between the respective first, second, third resistors 28, 30, 34 and the second ends 20 of the LED strings 14. The switches 42 are preferably set to a normally open state so that without voltage applied thereto, no current may flow therethrough. The switches 42 may be field effect transistors, more particularly, metal oxide semiconductor field effect transistors (MOSFETs), and, more particularly, n-channel type MOSFETs. As MOSFETs, the switches 42 may be activated with positive voltage applied to gates 44 by bias lines 40. With this arrangement, stray current is restricted from flowing into the LED strings 14, causing uncontrolled illumination thereof.

As shown in FIG. 5, bias resistors 45 may be provided along the bias lines 44 to control the amount of voltage being applied to the current regulators 36 and the switches 42.

Figure 7:
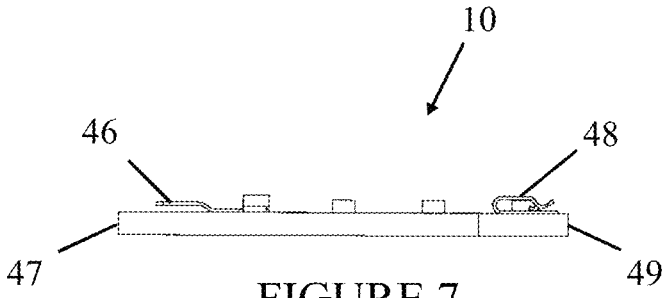
FIGS. 7-10 show different connectors useable with the subject invention.
Figure 8:
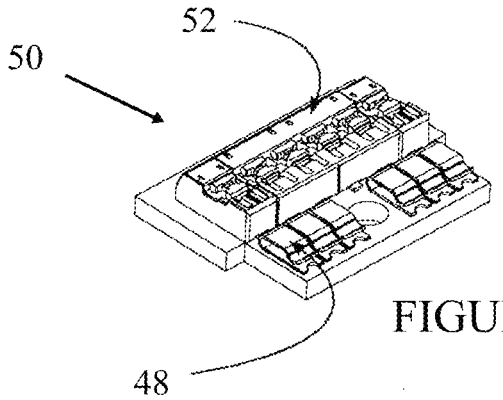
Figure 9:
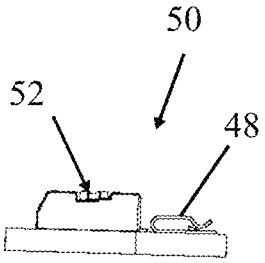

The module 10 may be used alone or in combination with other modules 10 as a system in forming a light fixture. The first, second, and third terminals 24, 26, 32 and the positive voltage terminal 22 may be configured in various manners to allow for the boards 12 of different modules 10 to electrically couple, as well as, to allow for electrical coupling with external electrical components, e.g., via wires. With reference to FIG. 7, the module 10 is shown with cooperating male and female connectors 46, 48. The male and female connectors 46, 48 are shown to be located at opposing first and second ends 47, 49 of the module 10, thus, allowing for end-to-end connection with similarly-configured modules 10. The male connector 46 is provided as a generally flat conductive element formed to slide into, and be engaged by, the female connector 48, which may be generally U-shaped with a downward depending arm for pressing engagement against the male connector 46. The female connector 48 is inherently biased to the closed position shown in FIG. 7 to maintain good contact with the received male connector 46.

A wire coupling module 50 may be provided having a plurality of wire-to-board connectors 52. The wire-to-board connectors 52 may be of various configurations, including the type which make electrical connection with the wires having been pushed thereinto, such as with Wago type connectors. The wire coupling module 50 may include a plurality of the female connectors 48 corresponding to the wire-to-board connectors 52. The female connectors 48 are electrically coupled with the wire-to-board connectors 52 to conduct therethrough electricity from the corresponding wire-to-board connectors 52. The wire coupling module 50 may be connected to one end of the module 10 using the female connectors 48, thereby allowing for wires to be connected to the module 10, albeit indirectly. The wire-to-board connectors 52 should correspond, in quantity and positioning, to the positive voltage terminal 22, and each of the terminals 24, 26, 32, as provided. Alternatively to utilizing the wire coupling module 50, the wire-to-board connectors 52 may be provided directly on the module 10 as any of the first, second, third terminals 24, 26, 32 and/or as the positive voltage terminal 22.

Figure 10:
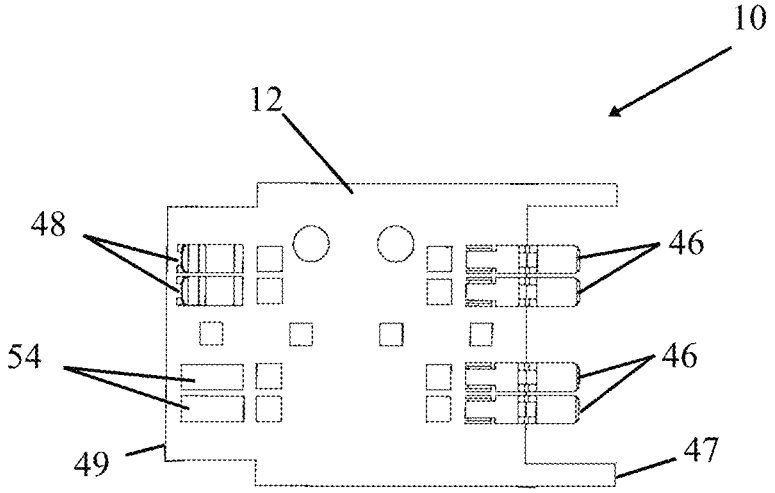

As further shown in FIG. 10, the first, second, third terminals 24, 26, 32 and/or the positive voltage terminal 22 may be configured as pads 54 to which wires may be soldered.

Figure 11:
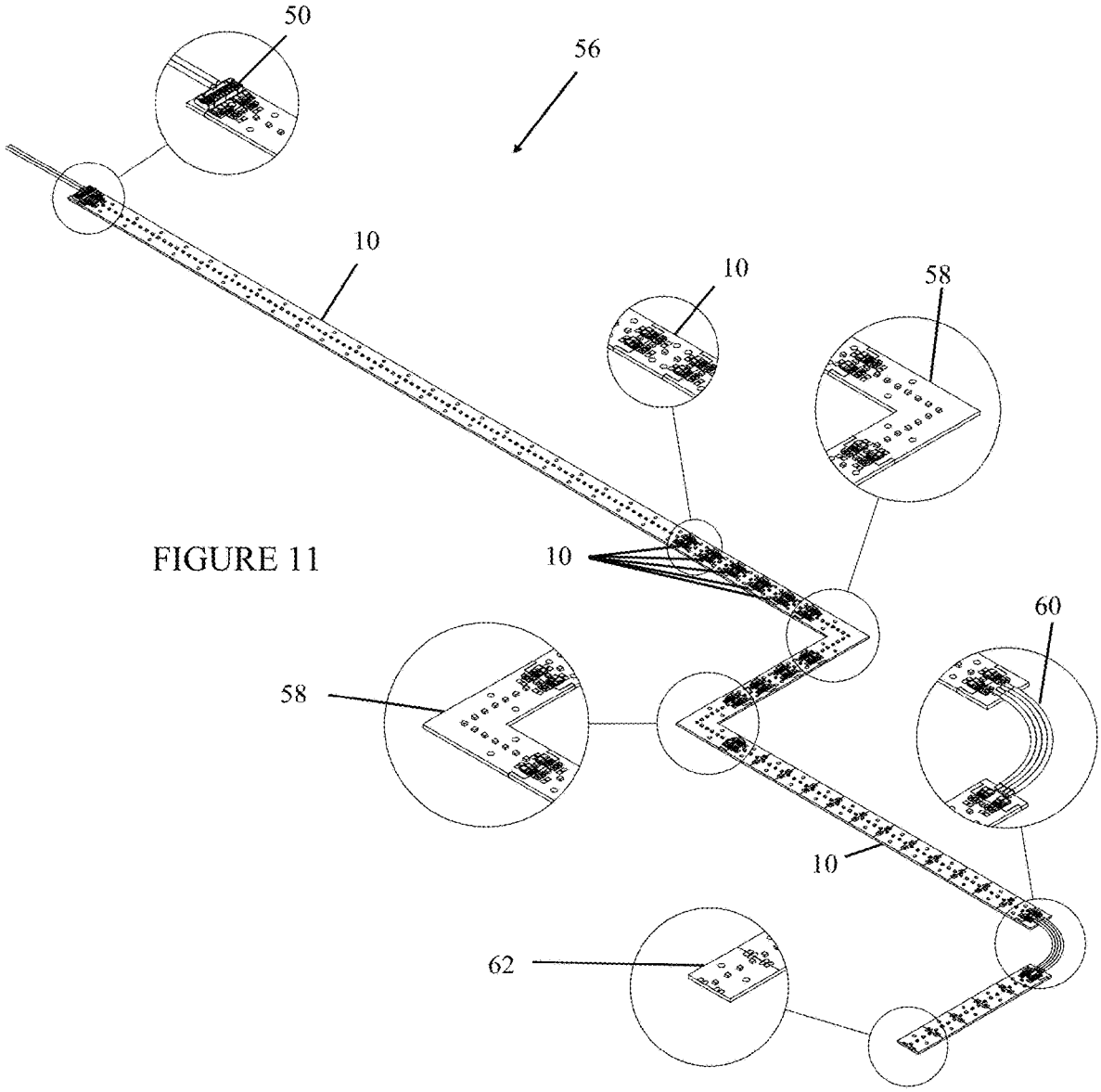
FIG. 11 is a perspective view of a system formed in accordance with the subject invention.
Figure 12:
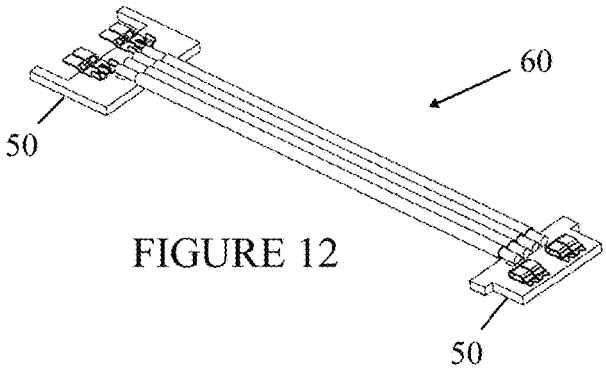
FIG. 12 shows jumper cables useable with a system in accordance with the subject invention.

As shown in FIG. 11, the module 10 may be connected with other modules 10 in forming a lighting system 56. The modules 10 of the system 56 may be provided with various configurations (shapes, lengths) for various installations, such as, accent lighting, recessed lighting, under-cabinet lighting, and so forth. The shape of the system 56 may be configured to the requirements of the installation. For example, the module 10 may be formed with a relatively short length (e.g., 1 inch), such as including one of the LED strings 14. Various quantities of the module 10 may be coupled together within the system 56. A short length for the modules 10 allows for greater variation in configuration (i.e., greater number of achievable lengths). Modules 10 of different lengths may be used in combination. For example, modules 10 may be provided in lengths of 1 inch, 24 inches, and 48 inches, which may be used in various combinations. In addition, the modules 10 may be bent to define corner-pieces 58 or other directional changes to provide non-linear arrangements of the system 56. As shown in FIG. 11, jumper cables 60 may be used to electrically couple a pair of adjacent modules 10 including in a non-linear fashion. As shown in FIG. 12, the jumper cables 60 may be connected at both ends to wire coupling modules 50, which in turn may be connected to two of the modules 10. Alternatively, the jumper cables 60 may be provided with the male and female connectors 46, 48 to connect directly to the modules 10. The jumper cables 60 may be also soldered to the pads 54. Optionally, a termination module 62 may be provided as an end piece for the system 56. The termination module 62 may cover any open contacts of the ultimate module 10 of the system 56.

Within the system 56, power must be conveyed from module to module. As shown in FIGS. 4 and 5, output terminals, in the same quantity as the terminals (22, 24, 26, 32) intended for connection with the direct current source of power, may be provided which allow for the conveyance of power to the next adjacent module 10. Thus, the positive voltage terminal 22 is connected to positive voltage output terminal 22B; the first terminal 24 is connected to first output terminal 24B; the second terminal 26 is connected to second output terminal 26B; the third terminal 32 is connected to third output terminal 32B; and, so forth, with each terminal having a corresponding output terminal. The output terminals (22B, 24B, 26B, 32B) of one of the modules 10 couple with input terminals (22, 24, 26, 32) of the adjacent module 10 utilizing the connectors described above, such as the board-to-board connectors (male and female connectors 46, 48), wire-to-board connectors 52, and/or soldered connections utilizing the pads 54. This allows for electrical coupling of the modules 10. Power is caused to flow through the positive voltage terminals (22, 22B) and through the terminals corresponding to the terminal (24, 26, 32) selected on the first module 10 connected to the source of direct current power. The output terminals (22B, 24B, 26B, 32B) are positioned to engage the input terminals (22, 24, 26, 32) in corresponding fashion, so that electrical flow is maintained on selected paths for the selected intensity.

It is noted that the selection of intensity of the light for the initial module 10 sets the intensity for the entire system 56. In other words, the first module 10 in the system 56 to which is connected the direct current power source, the selection of the first, second, third terminals 24, 26, 32 on the first module 10 determines the level of light intensity for the first module 10 and for the entire system 56.

FIGS. 4 and 5 show the input terminals (22, 24, 26, 32) and the output terminals (22B, 24B, 26B, 32B) being adjacent one another. This, however, is a schematic presentation. It is preferred that the input terminals (22, 24, 26, 32) be located adjacent the first end 47 of the module 10 while the output terminals (22B, 24B, 26B, 32B) are located adjacent the second end 49 of the module 10. This facilitates end-to-end connection of the modules 10. In addition, the first and second ends 47, 49 may be formed to shape-matingly engage, such as the first end 47 having a cut-out and the second end 49 having a shoulder profile shaped to be received in the cut-out to allow for greater stability in connections between the modules 10.

Figure 13:
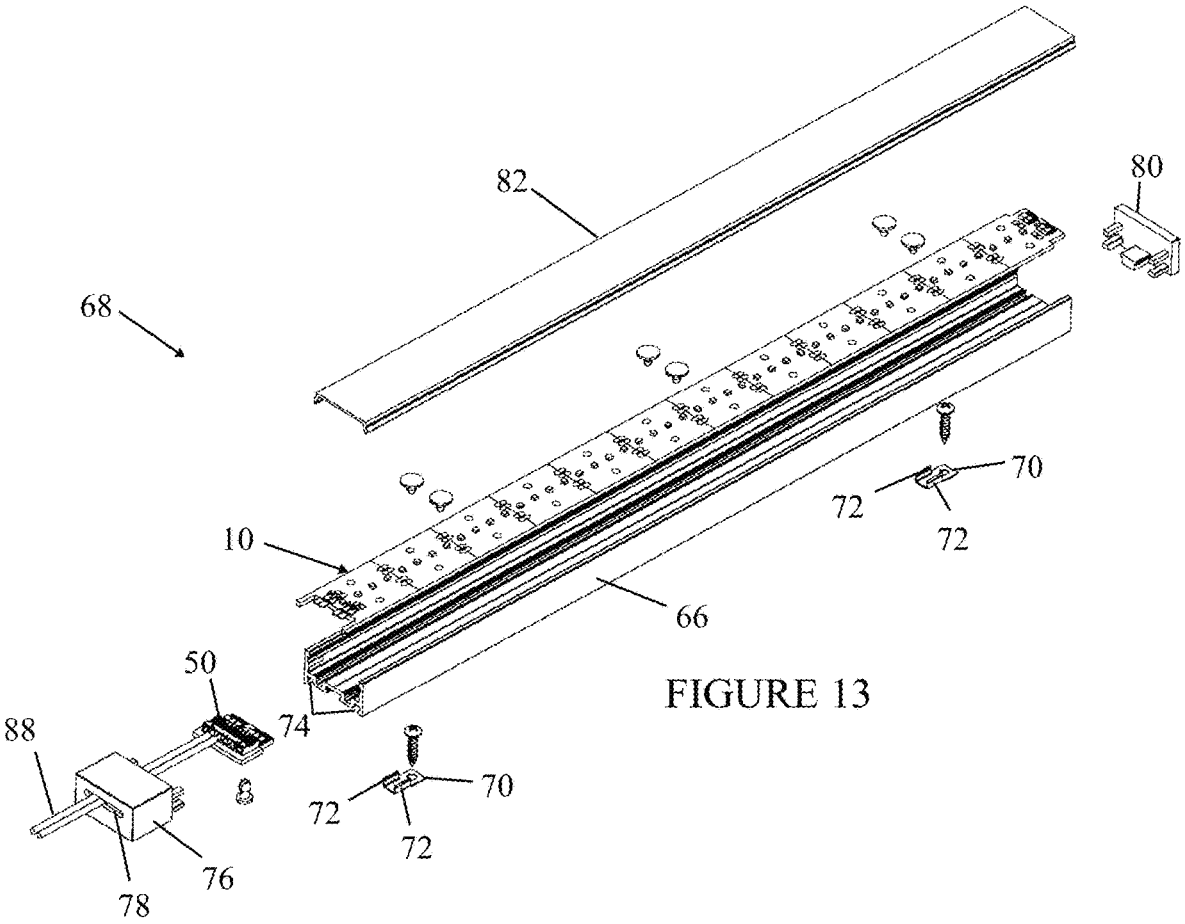
FIG. 13 is an exploded view of a light fixture formed in accordance with the subject invention.
Figure 15:
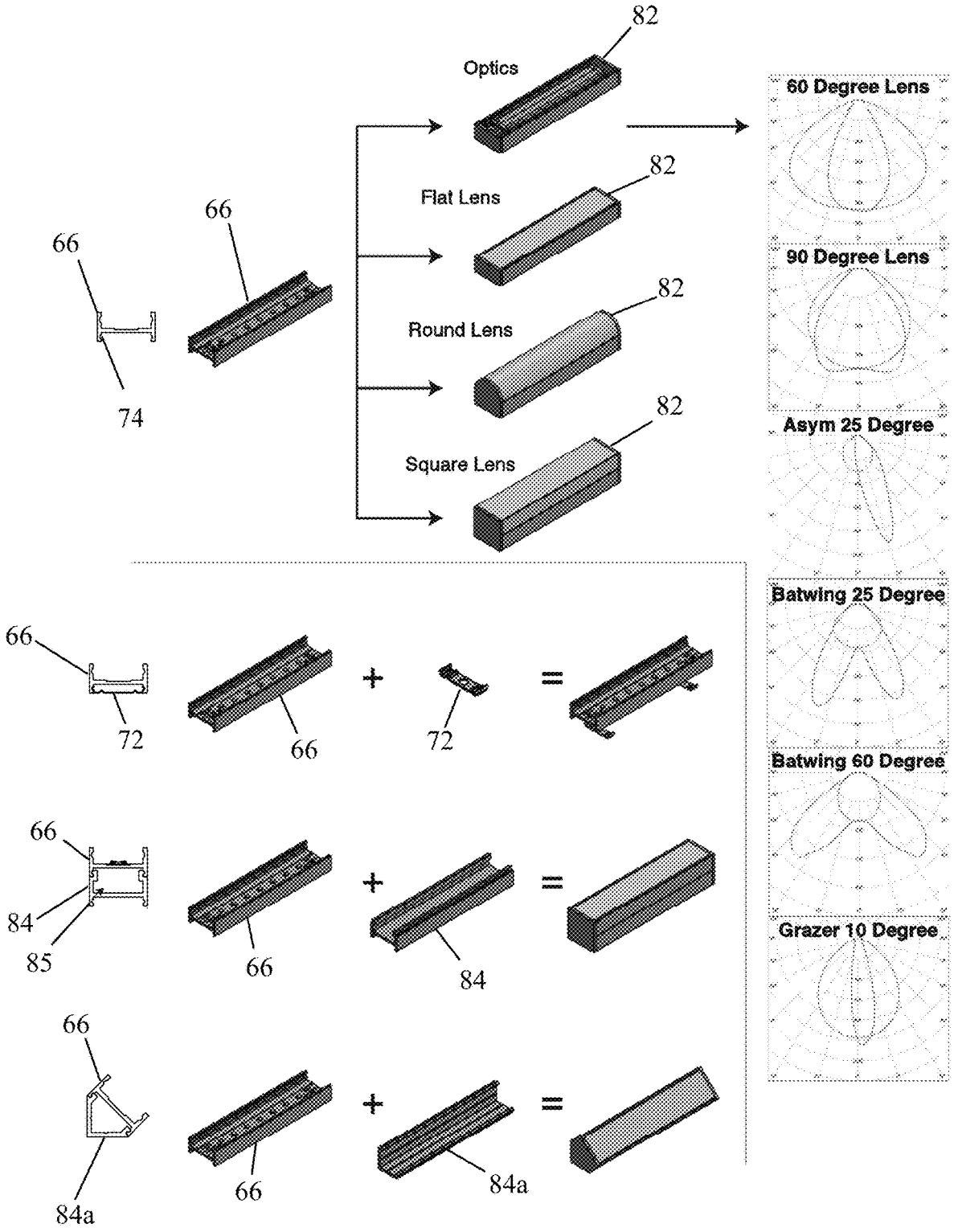
FIG. 15 shows variations of a light fixture in accordance with the subject invention.

As shown in FIG. 13, the module 10 or the system 56 may be mounted in one or more channel housings 66 in forming a light fixture 68. The channel housing 66 may be provided with straight lengths and corners corresponding to the shapes of the different modules 10, including the corner-pieces 58. The channel housing 66 is preferably a constant cross-section extrusion (plastic or metal) having an open channel for receiving one or more of the modules 10. Mounting flanges may be provided to protrude from the sides of the channel housing 66. Mounting clips 70 may be provided configured for securing the light fixture 68 to a support surface. The mounting clips 70 may have upstanding spring arms 72 which may engage, e.g., snap engage, mounting channel 74, located in the bottom of the channel housing 66, with sufficient holding force to maintain the channel housing 66 fixed thereto. Apertured end cap 76 may be provided having an aperture 78 which allows for passage of electrical wires therethrough, for example, power supply wires 88 for coupling with the wire coupling module 50. Solid end cap 80 may be also provided to close off the channel housing 66 at the end of the light fixture 68. The end caps 76, 80 are configured to cover all open electrical contacts. Lens 82 may be secured to the channel housing 66 above the module(s) 10. The lens 82 may be provided in various configurations, such, as shown in FIG. 15, as being flat, round, or square. The lens 82 may be also provided with various optics. This allows for different light patterns to be projected from the light fixture 68. The lens 82 may be formed of glass and/or a polymeric material. The lens 82 may be spaced from the module 10 to best even out light generated thereby. For example, the lens 82 may be spaced a distance of 0.5 inches from above the module 10.

In addition, as shown in FIG. 15, the channel housing 66 may be configured to be mounted to a secondary channel housing 84 which permits additional depth for the light fixture 68, including space 85 for electrical components and power supply, such as a driver. The secondary channel housing 84 may have an angled shape (84*a*), as shown in FIG. 15, to provide the light fixture 68 with an angled projection.

Figure 14A:
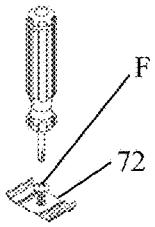
FIGS. 14A-14F show installation and preparation of a light fixture in accordance with the subject invention.
Figure 14B:
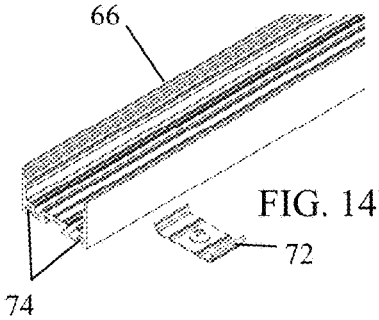
Figure 14C:
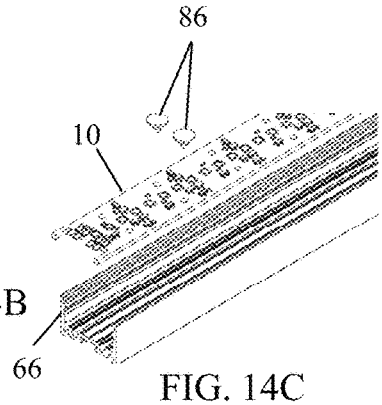
Figure 14D:
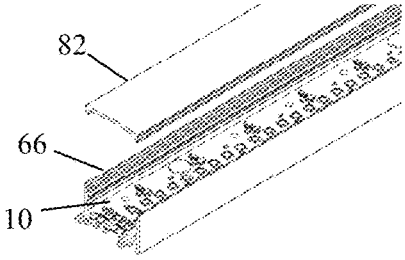
Figure 14E:
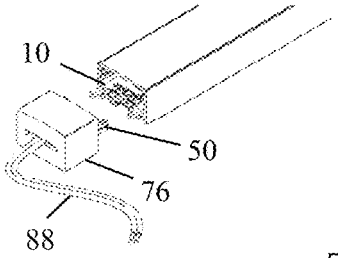
Figure 14F:
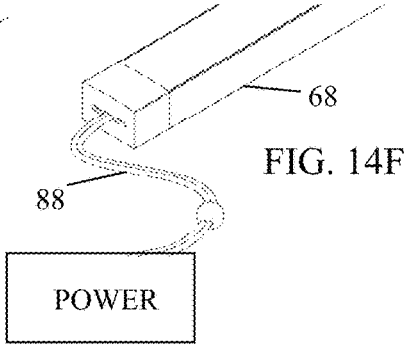

As shown in FIGS. 14A-14F, the light fixture 68 may be mounted and assembled by initially securing the mounting clips 72 to a support surface with fasteners F (FIG. 14A), securing thereto, by snap engagement, the mounting channel 74 of the channel housing 66 (Figure B). The module 10 is positioned within the channel housing 66 and fixed thereto, such as by rivets 86 (FIG. 14C). Other fasteners may be used to fix the module 10, such as screws and/or adhesives, including double-sided tape. The lens 82 is mounted to the channel housing 66 above the module 10 (FIG. 14D). The module 10 may be coupled to power utilizing the wire coupling module 50 with power supply wires 88 being connected thereto extending through the apertured end cap 76 (FIG. 14E). The power supply wires 88 may be connected with a source of power, such as a direct current source of power (FIG. 14F).

Figure 16:
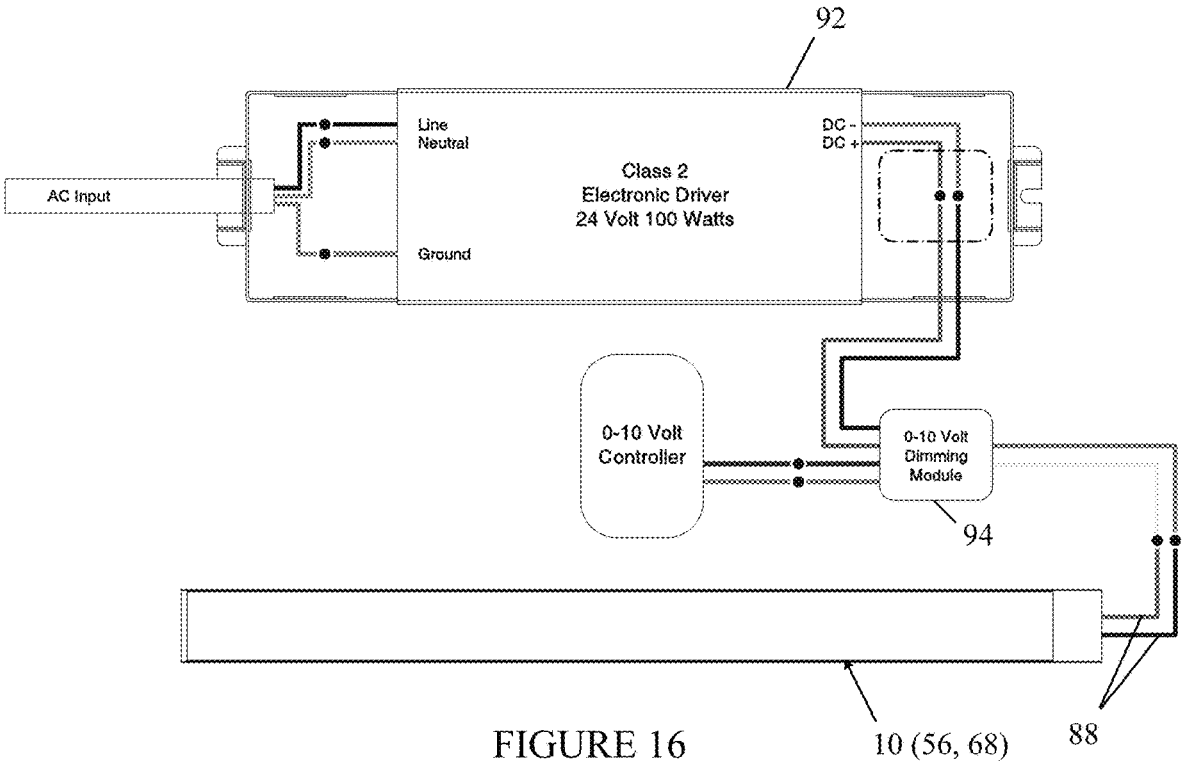
FIG. 16 shows schematically a driver and dimmer configuration useable with the subject invention.

The power supply wires 88 may convey power from a direct current power source, such as a battery or solar panel. The power supply wires 88 may also convey power from an AC/DC converter, such as a driver. As shown in FIG. 16, driver 92 may be utilized with the system 56 and the light fixture 68 to convert inputted alternating current to outputted direct current usable with the module(s) 10, either alone, or in the system 56 or the light fixture 68. A dimming module 94 may be provided along the outputted direct current to vary the voltage thereof in providing for dimming control of the module(s) 10, relative to the set intensity.

What is claimed is:

1. A variable-intensity light emitting diode (LED) module comprising:

a board;

a first LED string, mounted to the board, having first and second ends, the first end being connected to a positive voltage terminal which is connectable to a positive voltage input of a direct current voltage source;

a first terminal, mounted to the board, connected to a first resistor which is connected to the second end of the first LED string;

a second terminal, mounted to the board, connected to a second resistor which is connected to the second end of the first LED string;

wherein, the first and second resistors have different resistances, and wherein, a negative voltage input of the direct current voltage source is selectively connectable to one of the first and second terminals, whereby, the intensity of light generated by the first LED string is determined by which of the first and second terminals is connected to the negative voltage input.

2. A LED module as in claim 1, wherein the first LED string includes white LEDs.

3. A LED module as in claim 1, wherein a first current regulator is provided in parallel to the first resistor.

4. A LED module as in claim 3, wherein the first current regulator defines a constant voltage across the first resistor.

5. A LED module as in claim 4, wherein the first current regulator includes a Zener diode.

6. A LED module as in claim 3, wherein a first switch is provided between the first resistor and the second end of the first LED string configured to selectively allow flow of electrical current from the first resistor to the second end of the first LED string.

7. A LED module as in claim 6, wherein the first switch is a field effect transistor.

8. A LED module as in claim 7, wherein the first switch is a metal oxide semiconductor field effect transistor (MOSFET).

9. A LED module as in claim 8, wherein the first switch is a n-channel type MOSFET.

10. A LED module as in claim 8, wherein a bias line is connected to the positive voltage terminal to define a bias voltage applied to a gate of the first switch and to the first current regulator.

11. A LED module as in claim 1, further comprising a third terminal, mounted to the board, connected to a third resistor which is connected to the second end of the first LED string, wherein, the resistance of the third resistor is different from the resistances of the first and second resistors.

12. A LED module as in claim 1, wherein the first terminal is configured as a wire-to-board connector.

13. A LED module as in claim 1, wherein the first terminal is configured as a board-to-board connector.

14. A LED module as in claim 1, wherein the first terminal is configured as a pad.

15. A LED module as in claim 1, wherein the positive voltage terminal is connected to a positive voltage output terminal.

16. A LED module as in claim 15, wherein the board is elongated along a longitudinal axis with first and second ends being spaced apart along the longitudinal axis, and, wherein, the positive voltage terminal is located adjacent to the first end and the positive voltage output terminal is located adjacent to the second end.

17. A LED module as in claim 16, wherein the first terminal is connected to a first output terminal.

18. A LED module as in claim 17, wherein the first terminal is located adjacent to the first end and the first output terminal is located adjacent to the second end.

19. A LED module as in claim 18, wherein the second terminal is connected to a second output terminal.

20. A LED module as in claim 19, wherein the second terminal is located adjacent to the first end and the second output terminal is located adjacent to the second end.

* * * * *